US005555808A

United States Patent [19]

Miltner

[11] Patent Number: 5,555,808

[45] Date of Patent: Sep. 17, 1996

[54] METHOD AND DEVICE FOR DETERMINING THE DEGREE OF SOILING OF A PRINTING UNIT OF A PRINTING MACHINE

[75] Inventor: Karl-Hermann Miltner, Dossenheim, Germany

[73] Assignee: Heidelberger Druckmaschinen AG, Heidelberg, Germany

[21] Appl. No.: 389,981

[22] Filed: Feb. 14, 1995

Related U.S. Application Data

[63] Continuation of Ser. No. 72,416, Jun. 2, 1993.

[30] Foreign Application Priority Data

Jun. 2, 1992 [DE] Germany ..... 42 18 127.5

[51] Int. Cl.[6] ..... B41F 35/00

[52] U.S. Cl. ..... 101/425; 101/424

[58] Field of Search ..... 101/425, 424, 101/423; 355/307; 137/237; 356/436; 68/12.02

[56] References Cited

U.S. PATENT DOCUMENTS

| | | | |
|---|---|---|---|
| 3,888,269 | 6/1975 | Bashark | 134/113 |
| 4,437,757 | 3/1984 | Komori et al. | 355/307 |
| 4,774,884 | 10/1988 | Sugimoto et al. | 101/170 |
| 5,048,139 | 9/1991 | Matsumi et al. | 68/12.02 |
| 5,129,241 | 7/1992 | Kiuchi et al. | 68/12.02 |
| 5,172,572 | 12/1992 | Ono | 68/12.02 |
| 5,194,921 | 3/1993 | Tambo et al. | 356/436 |
| 5,230,863 | 7/1993 | Salpeter | 356/436 |

FOREIGN PATENT DOCUMENTS

| | | | |
|---|---|---|---|
| 0065166 | 11/1982 | European Pat. Off. . | |
| 0186193 | 7/1986 | European Pat. Off. . | |
| 1598831 | 9/1970 | Germany . | |
| 2361752 | 6/1974 | Germany . | |
| 2429832 | 1/1975 | Germany . | |
| 2924048 | 12/1980 | Germany . | |
| 3140760 | 8/1982 | Germany | 101/425 |
| 3424711 | 2/1986 | Germany . | |
| 9007142 | 10/1990 | Germany . | |
| 4101107 | 8/1991 | Germany . | |
| 4002154 | 8/1991 | Germany . | |
| 4006689 | 8/1991 | Germany . | |
| 0006558 | 2/1990 | Japan | 68/12.02 |
| 2277498 | 11/1990 | Japan | 68/12.02 |

OTHER PUBLICATIONS

GIT Fachz. Lab, Jun. 1982, W. Maurer, pp. 559–564 "Direct Quantitative Determination of Color for Turbid Waste Water . . . ".

TR No. 5, Feb. 1977, R. Landbeck, 1 page "Instrumentation of a Waste Water Plant".

Cont. of TR 3, Jan. 1977, Albert Kloss, 1 page "Fundamental Principles of Electronic Power Devices".

*Primary Examiner*—Edgar S. Burr
*Assistant Examiner*—Anthony H. Nguyen
*Attorney, Agent, or Firm*—Herbert L. Lerner; Laurence A. Greenberg

[57] ABSTRACT

A method and a device are disclosed for determining a degree of fouling of a printing unit of a printing machine. The method comprises washing a printing unit with a washing medium. A degree of fouling of the washing medium is measured, and a degree of fouling of the printing unit is determined from the degree of fouling of the washing medium. The device for performing the method comprises a translucent conduit, such as a transparent pipe, through which the washing medium in the form of a washing solution is conducted. A light source is disposed on one side of the conduit for shining light through the conduit. An optical sensor is disposed on the other side of the conduit opposite from the light source. The sensor receives the light which permeates the conduit. The degree of absorption of the light in the washing medium is proportional to its degree of soiling.

14 Claims, 3 Drawing Sheets

METHOD AND DEVICE FOR DETERMINING THE DEGREE OF SOILING OF A PRINTING UNIT OF A PRINTING MACHINE

This application is a continuation of application Ser. No. 08/072,416, filed Jun. 2, 1993.

BACKGROUND OF THE INVENTION

1. Field of the Invention

The invention relates to a method and a device for determining the degree of fouling or soiling of a printing unit of a printing machine.

2. Description of the Related Art

In the prior art, rubber blankets, impression cylinders, or the inking units of offset printing machines, for example, have been washed on an empirical basis. In other words, the printing machine operator has to determine the proper timing in the washing cycle, i.e. the point at which the washing cycle should be initiated and the number of spraying runs per washing cycle. Alternatively, washing programs in an automatic control may be set up such that a washing cycle is performed at a fixed point in time depending on the type of machine or the print job. In so doing, there may be cases in which a fixed amount of washing solution is used up, even though much less washing solution would suffice for the washing cycle in many cases. That scenario would also mean a shorter washing cycle, with fewer discrete spraying runs. The rather inaccurate estimates by the operator thus cause an increased use of washing medium. Washing medium may be toxic, explosive or otherwise detrimental to the environment.

German Published, Non-Prosecuted application DE-OS 15 98 831 describes a device for measuring the cloudiness or opacity of a fluid. The device is particularly suited for measuring the degree of opacity of fluids which carry a high concentration of an opaque agent.

Further methods of determining the degree of fouling of an opaque fluid are also conceivable such as, for example, physical, chemical or electrochemical techniques.

SUMMARY OF THE INVENTION

It is accordingly an object of the invention to provide a method and device for determining the degree of soiling of a printing unit of a printing machine, which overcomes the hereinafore-mentioned disadvantages of the heretofore-known devices of this general type and which allows a very accurate and efficient control of the fouling of a printing unit by determining the degree of fouling of the washing medium of a washing device of a printing machine, thus reducing the duration of the washing cycle on the one hand and saving in the use of washing solution on the other hand.

With the foregoing and other objects in view there is provided, in accordance with the invention, a method for determining a degree of fouling of a printing unit of a printing machine, which comprises determining a degree of fouling of a washing medium; and determining a degree of fouling of the printing unit from the degree of fouling of the washing medium. In other words, the degree of fouling of the printing unit is indirectly determined from a measurement of the washing medium.

During the washing cycle dirt particles (for example, ink particles) come off the cylinders or rollers and are removed together with the washing solution. Thus, the washing solution differs in quality prior to the washing cycle and upon completion of the washing cycle, and, in fact, it changes steadily between washing runs or spraying runs. The invention provides a method for determining the degree of fouling of a printing unit, for example, by defining the degree of fouling of the washing solution. This method makes it possible to obtain information on the impurities still present in the respective device of the printing machine. If no difference is detected in the washing solution prior to the washing cycle and after the washing cycle, one may infer that there are no impurities on the devices of the printing machine to be cleaned. If the impurities released from the device are absorbed by a felt cloth, it is possible to infer the condition of the device of the printing machine to be cleaned from the fouling of the felt cloth.

In accordance with an added feature of the invention, the method further comprises: performing at least a first and a second spraying run on a printing unit with a washing medium; measuring the degree of fouling of the washing medium after the first and second spraying runs; and predicting a number of further spraying runs necessary in a washing cycle from the respective degrees of fouling in the first and second spraying runs.

In accordance with another feature of the invention, the method further comprises, in the predicting step, determining a characteristic curve of the degree of fouling of the washing medium from the at least first and second spraying runs and predicting the number of further spraying runs from the characteristic curve.

The degree of fouling is preferably defined by determining a characteristic curve. The curve is graphed from the values obtained in measuring the degree of fouling of the washing medium. In the case of discrete measurements, at least two spraying runs of a washing cycle are necessary to determine the characteristic curve. The curve shows the relationship of the degree of fouling of the washing solution over the number of spraying runs, and it allows to predetermine or predict the number of spraying runs required per washing cycle on the basis of this function.

The washing cycle can be described in a plotted function, in which the degree of fouling of the washing solution is a function of the number of spraying runs required per washing cycle. In most instances, a function of the form $y=a*e^{-bx}$, where a and b are constants, accurately describes the degree of fouling. If two points of the function are known—as determined, for example, after two spraying runs—the curve may be plotted into the points and any intercepts or other interesting points of intersection may be extrapolated from the function. From experience it is known that very little benefit is had from continuing the washing cycle after a certain degree of cleanliness of the printing unit has been reached. The afore-described function makes it thus possible to predetermine when the washing cycle should be completed.

In accordance with an additional feature of the invention, the step of determining the degree of fouling of the washing medium comprises optically measuring a degree of absorption in the washing medium.

In accordance with further features of the invention, the step of determining the degree of fouling of the washing medium comprises chemically reacting the washing medium with a reactant and determining the degree of fouling of the washing medium from the reaction, or measuring a density of the washing medium and comparing the density with a predetermined setpoint density, or measuring an eletrical conductivity of the washing medium. In the latter case, the method includes adding an electrically conductive substance to a printing ink in the printing unit prior to measuring the electrical conductivity of the washing medium.

In the various embodiments it is thus possible to implement a number of different methods of determining the degree of fouling of the washing solution. For instance, it may be determined optically by measuring a degree of absorption of the washing medium, in that case a washing solution. Other measuring techniques include chemical proofs in the form of reactions and physical measurements by determining the density of the fluid. Alternatively, the degree of fouling may be determined by measuring the electrical conductivity of the washing solution. In that case it is advantageous if conductive substances are added to the printing ink.

In accordance with again an added feature of the invention, the washing medium may be reused if a degree of fouling thereof lies below a given threshold value. The degree of fouling is determined as described above. This method step is particularly advantageous with regard to the environment.

With the foregoing and other objects in view, there is further provided, in accordance with the invention, a device for determining a degree of fouling of a printing unit of a printing machine, comprising translucent conduit means for conducting a washing medium, a light source disposed on a side of the conduit means for shining light through the conduit means, and optical sensor means disposed on another side of the conduit means opposite from the light source for receiving the light originating at the light source and permeating the conduit means. In a preferred embodiment the light source is a white light source.

In accordance with again an added feature of the invention, the device includes control means connected to the optical sensor means for receiving signals issued by the sensor means and for determining a degree of fouling of the washing medium in the conduit means.

In accordance with again another feature of the invention, the device including a color filter disposed between the light source and the sensor means and, in accordance with a concomitant feature of the invention, the color filter has a color complementary to an ink in the printing unit.

In other words, the preferred device for performing the method according to the invention includes a translucent or a transparent pipe through which the washing solution flows, a light source for supplying light, preferably white light, and an optical sensor. The white light permeates the pipe and impinges on the sensor.

The color filter disposed between the light source and the sensor features that color which is complementary to the ink in the printing unit. This allows for a color-specific determination. The color filter (e.g. red, green or blue) is preferably disposed between the light source of the white light and the pipe through which the fouled washing solution flows. Accordingly, filtered light, i.e. colored light (red, green, or blue), is radiated through the pipe and the respective ink component (cyan, magenta, yellow) in the washing solution is determined by means of the optical sensor.

Other features which are considered as characteristic for the invention are set forth in the appended claims.

Although the invention is illustrated and described herein as embodied in a method and device for determining the degree of soiling of a printing unit of a printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
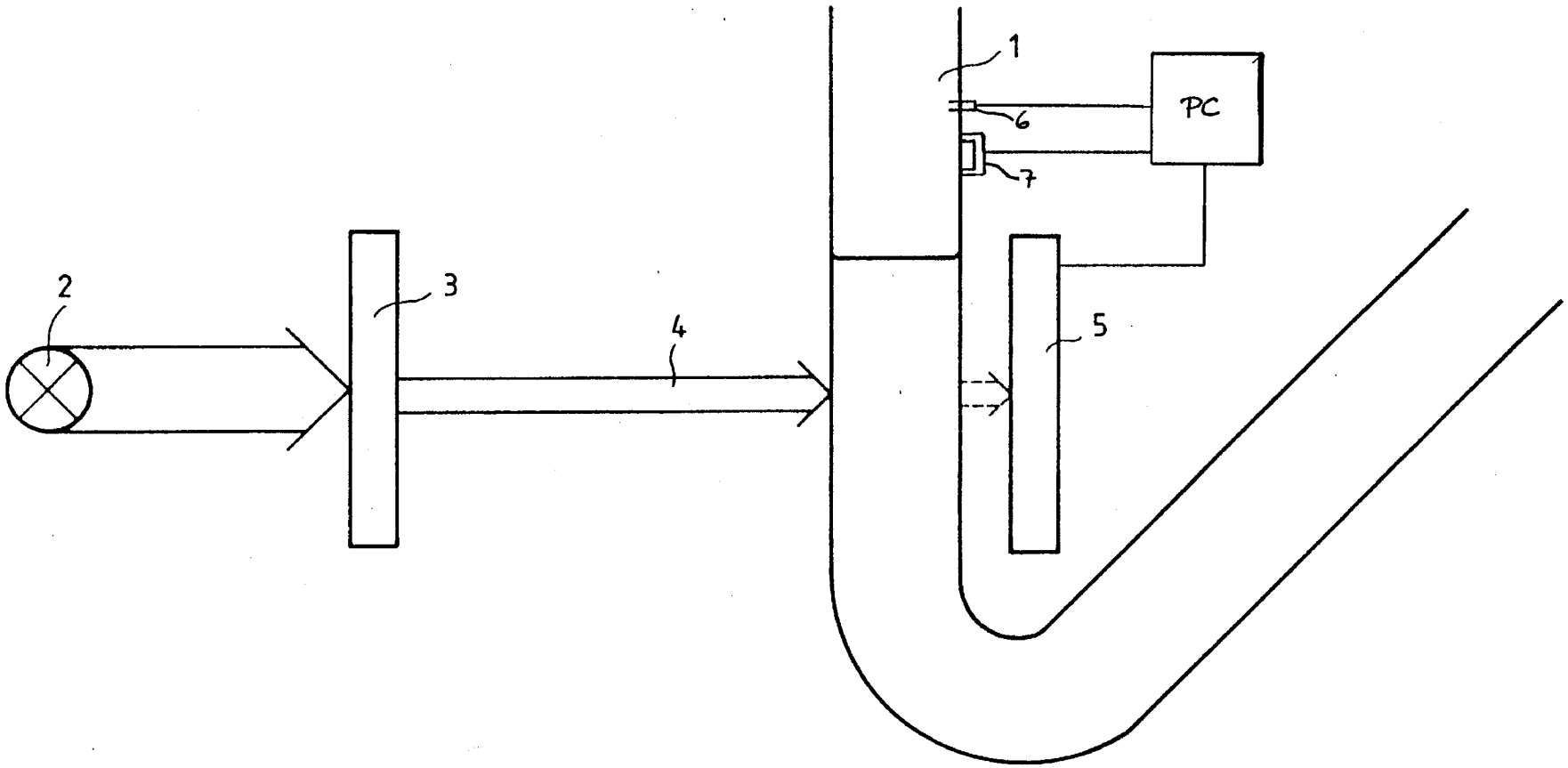
FIG. 1 is a diagrammatic view of a device according to the invention.

Referring now to the figures of the drawing in detail and first, particularly, to FIG. 1 thereof, there is seen a translucent conduit in the form of a transparent pipe 1 through which fouled washing medium flows. A light source 2 provides white light to be transmitted through the pipe 1. Before the light from the light source 2 reaches the pipe 1, it is filtered in a color filter 3. The color filter 3 is chosen as a function of the printing ink in the printing unit. For instance, the color filter 3 has a color which is complementary to the printing ink, usually red, green or blue. Accordingly, the pipe 1 through which the fouled washing medium flows is permeated by red, green or blue light 4. If the washing medium is fouled with cyan, magenta or yellow ink, then red, green or blue light 4, respectively, is absorbed in the pipe 1.

The degree of absorption is measured by means of an optical sensor 5. The optical sensor 5 is calibrated in that clean washing solution is led through the pipe 1. The degree of fouling may be determined as a ratio of a setpoint value determined for a clean washing solution and a value obtained for the fouled washing solution. The measured values from the sensor 5 are utilized in a control means PC. The control means may be incorporated in the printing control or it may be provided as a stand-alone unit, such as in a PC.

In an alternative embodiment of the invention, the degree of fouling of the washing medium is determined by measuring its electrical conductivity at a probe 6. In a preferred embodiment, electrically conductive substances are added in the printing ink of the printing unit.

In yet an alternative embodiment of the invention, the degree of fouling of the washing medium is determined by measuring its density at a tubula 7. The measured values may then be compared with a predetermined value, for instance the density of a clean washing medium, and the characteristic curves as will be described in the following may be derived from the comparison.

Figure 2:
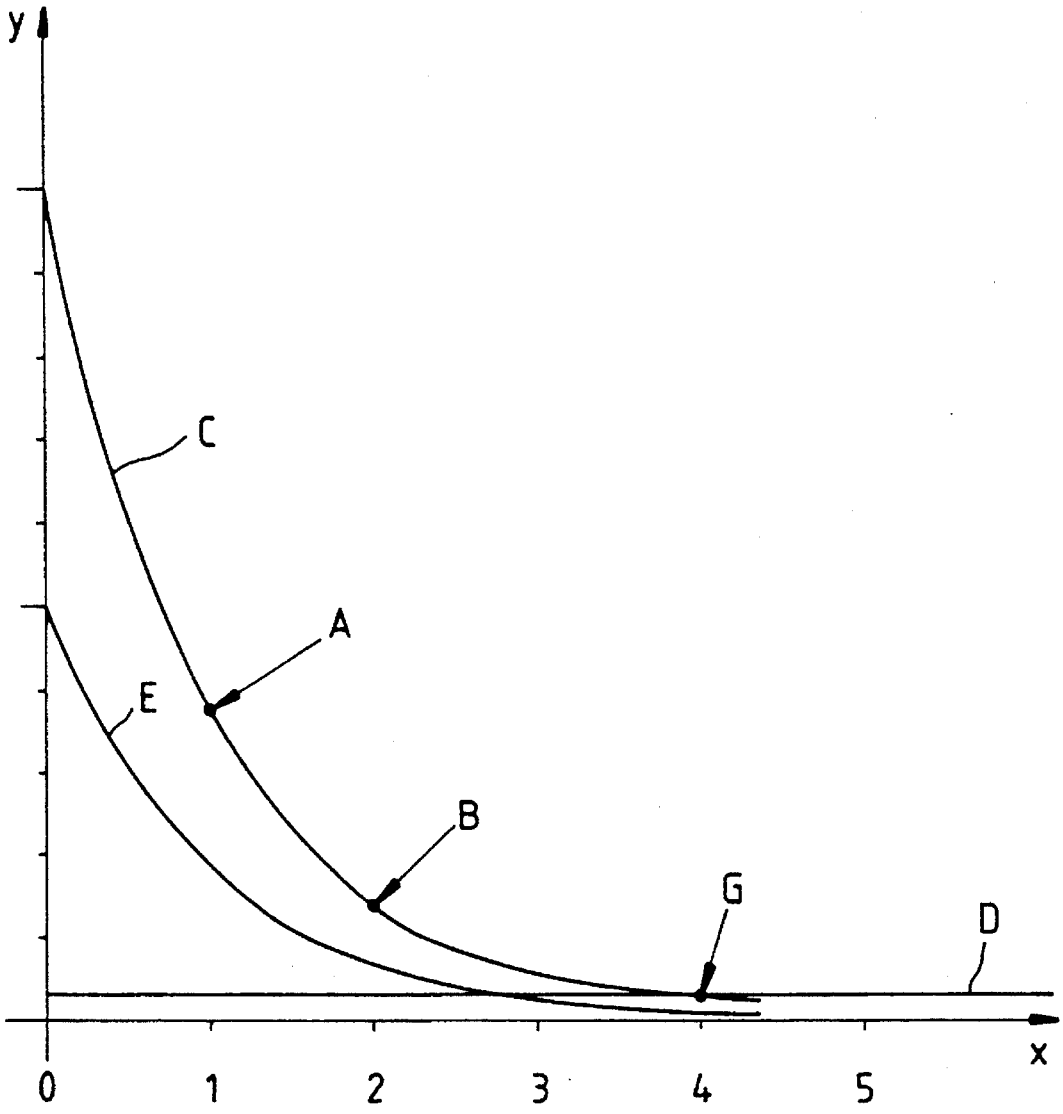
FIG. 2 is a graph showing characteristic curves.

Referring now to FIG. 2, which shows a cartesian coordinate system, on the x-axis there is plotted the number of spraying runs required per washing cycle. The values determined for the degree of fouling of the washing solution is represented on the y-axis. Three curves C, D and E are drawn in the graph. The curve C is a function indicating a high degree of fouling of the printing unit. Curve E stand for average fouling, and constant D represents a value at which no further spraying runs are required, i.e. an acceptable degree of fouling.

After a first spraying run in the washing cycle, a degree of fouling A is plotted at the point shown. A second spraying run reduces the degree of fouling to the point B. At this point, a curve C may be plotted through the points A and B. The curve C has the form $y=ae^{-bx}$ (or $f(x)=a*\exp\{-bx\}$), where a and b are constants. The constant a is the y-intercept, i.e. the extrapolated degree of fouling at the initiation of the cleaning cycle and b is empirically determined. At this point, by simply determining the points A and B, it is possible to predict the point G at which the curve C will intersect the constant threshold value D. The exemplary washing cycle illustrated in the curve D thus will not require more than four spraying runs. The washing cycle plotted in the curve E thus will require only three spraying runs.

It is understood by those skilled in the art that the cleaning cycle need not be effected by discrete spraying runs. Instead, it is possible to operate a continuous washing cycle in which the washing solution is added continuously and the measurements are taken at shorter intervals or continuously as well.

Moreover, the required duration of the washing cycle may be determined by constantly comparing the degree of fouling of the used washing solution with the unused washing solution. The essential advantage thereof is that the duration of the washing cycle. i.e. the number of spraying runs, may be minimized, and thus washing solution may be saved.

Figure 3:
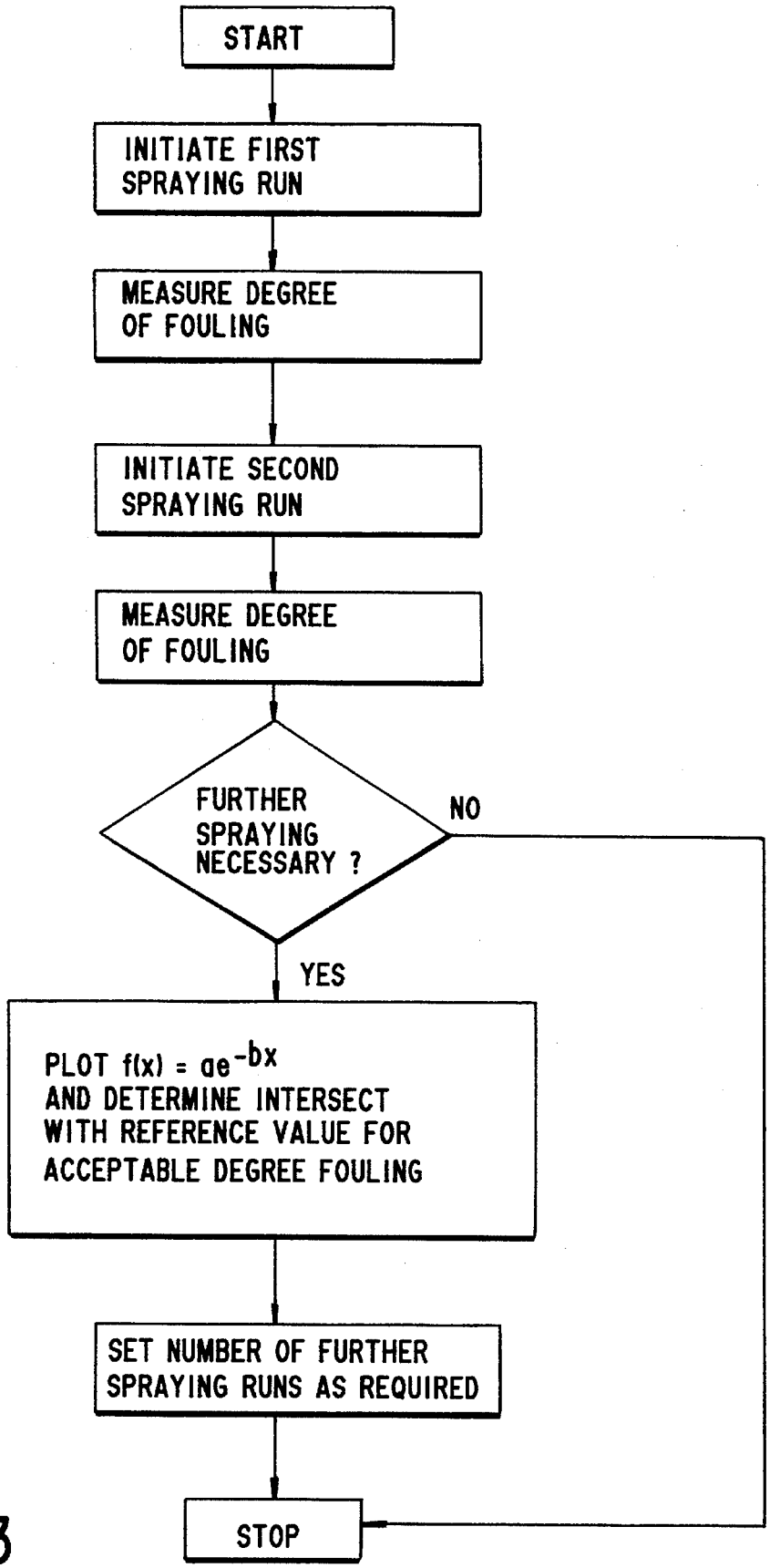
FIG. 3 is a flow chart of an exemplary program run.

Referring now to FIG. 3, a first spraying run is initiated and a first degree of soiling is measured. After the second spraying, a second degree of soiling is measured. At that point it may be possible that the two runs have already cleaned the unit sufficiently. Accordingly, a query is set whether or not further runs are necessary. If the answer is yes, the first and second measured values are plugged into an exponential function, such as $y=ae^{-bx}$. The function is extended through several integer x-values, until the value of y(x) falls below a threshold value. The threshold value is defined as the reference value for an acceptable degree of fouling. The number of further required spraying runs is the number of x-values through which the function had to proceed before it reached the threshold value. The number of further spraying runs is thus the minimum required for acceptably cleaning the printing unit.

I claim:

1. A method for determining a degree of fouling of a printing unit of a printing machine, which comprises:

determining a degree of fouling of a washing medium used in washing a printing unit; and determining a degree of fouling of the printing unit from the degree of fouling of the washing medium, performing at least a first and a second spraying run on a printing unit with a washing medium; measuring the degree of fouling of the washing medium after the first and second spraying runs; and predicting a number of further spraying runs necessary in a washing cycle from the respective degrees of fouling in the first and second spraying runs.

2. The method according to claim 1, which comprises, in the predicting step, determining a characteristic curve of the degree of fouling of the washing medium from the at least first and second spraying runs and predicting the number of further spraying runs from the characteristic curve.

3. The method according to claim 1, wherein the step of determining the degree of fouling of the washing medium comprises optically measuring a degree of absorption in the washing medium.

4. The method according to claim 1, wherein the step of determining the degree of fouling of the washing medium comprises chemically reacting the washing medium with a reactant and determining the degree of fouling of the washing medium from the reaction.

5. The method according to claim 1, wherein the step of determining the degree of fouling of the washing medium comprises measuring a density of the washing medium and comparing the density with a predetermined setpoint density.

6. The method according to claim 1, wherein the step of determining the degree of fouling of the washing medium comprises measuring an eletrical conductivity of the washing medium.

7. The method according to claim 6, which comprises adding an electrically conductive substance to a printing ink in the printing unit prior to measuring the electrical conductivity of the washing medium.

8. The method according to claim 1, which comprises reusing the washing medium if a degree of fouling thereof lies below a given threshold value.

9. In combination with a printing machine having a printing unit, a device for determining a degree of fouling of the printing unit of the printing machine, comprising translucent conduit means for conducting a washing medium, a light source disposed on a side of said conduit means for shining light through said conduit means, and optical sensor means disposed on another side of said conduit means opposite from said light source for measuring the light originating at said light source and permeating said conduit means.

10. The device according to claim 9, including control means connected to said optical sensor means for receiving signals issued by said sensor means and for determining a degree of fouling of the washing medium in said conduit means.

11. The device according to claim 9, wherein said light source is a white light source.

12. The device according to claim 11, including a color filter disposed between said light source and said sensor means.

13. The device according to claim 12, wherein said color filter has a color complementary to an ink in the printing unit.

14. A method for determining a degree of fouling of a printing unit of a printing machine, which comprises:

washing a printing unit with a washing medium; conducting the washing medium away from the printing unit; subsequently measuring a degree of fouling of the washing medium; and determining a degree of fouling of the printing unit from the degree of fouling of the washing medium, and in the washing step, performing at least two spraying runs on the printing unit with the washing medium; in the measuring step, measuring the degree of fouling of the washing medium after each of the two spraying runs; and predicting a number of further spraying runs necessary in a washing cycle from the respective degrees of fouling in the two spraying runs.

* * * * *